US005678400A

United States Patent [19]

Heard

[11] Patent Number: 5,678,400

[45] Date of Patent: Oct. 21, 1997

[54] CABLED YARN UNTWISTER AND METHOD

[75] Inventor: Joseph Mitchell Heard, Anderson, S.C.

[73] Assignee: BASF Corporation, Mount Olive, N.J.

[21] Appl. No.: 598,686

[22] Filed: Feb. 8, 1996

[51] Int. Cl.[6] ..... D01H 4/00

[52] U.S. Cl. ..... 57/1 UN; 57/2.3; 57/2.5

[58] Field of Search ..... 57/1 UN, 2.3, 57/2.5

[56] References Cited

U.S. PATENT DOCUMENTS

| | | | |
|---|---|---|---|
| 3,182,697 | 5/1965 | Carruthers | 57/2.3 |
| 3,866,403 | 2/1975 | Zimmermann, Jr. | 57/1 UN |
| 3,972,304 | 8/1976 | Boucher | 57/2.3 |
| 4,286,428 | 9/1981 | Bassani | 57/1 UN |
| 4,574,570 | 3/1986 | Franzen | 57/1 UN |
| 4,584,829 | 4/1986 | Heinke | 57/2.3 |
| 4,880,038 | 11/1989 | Meinershagen | 140/93.6 |
| 4,936,084 | 6/1990 | Matsui et al. | 57/22 |
| 5,004,020 | 4/1991 | Meinershagen | 140/93.6 |
| 5,052,172 | 10/1991 | Matsui et al. | 57/22 |
| 5,167,111 | 12/1992 | Cottenceau et al. | 57/1 UN |
| 5,271,131 | 12/1993 | Jacumin | 26/87 |
| 5,289,673 | 3/1994 | Cottenceau et al. | 57/1 UN |

FOREIGN PATENT DOCUMENTS

| | | | |
|---|---|---|---|
| 385207 | 11/1923 | Germany | 57/2.5 |
| 38339 | 10/1978 | Japan | 57/1 UN |

*Primary Examiner*—William Stryjewski
*Attorney, Agent, or Firm*—Nixon & Vanderhye P.C.

[57] ABSTRACT

A cabled yarn untwister untwists cabled yarn to obtain yarn components. The cabled yarn untwister includes an untwister frame that is rotated by a motorized drive unit (e.g., a hand-held electric drill). The untwister frame is preferably substantially T-shaped and includes a connector leg forming the base of the T-shape and a cross-wise extending yarn attatchment arm. The yarn components are attached to swivels disposed at opposing ends of the yarn attachment arm after which the untwister frame is rotated by the motorized drive unit while maintaining the cabled yarn under tension. Rotation of the untwister frame, in turn, causes the opposing ends of the yarn attachment arm to move in a generally circular orbital path and thereby untwist the individual yarn components of the cabled yarn.

16 Claims, 3 Drawing Sheets

CABLED YARN UNTWISTER AND METHOD

FIELD OF THE INVENTION

The present invention relates generally to the field of synthetic filaments. In preferred forms, the present invention is embodied in a device that serves to untwist cabled yarn so as to enable testing of individual yarn components.

BACKGROUND AND SUMMARY OF THE INVENTION

Multiple plied carpet yarns are sometimes twisted into cabled yarn to provide an end product that is particularly suited for customer carpet specifications. For example, different colored yarn components may be twisted together to provide a cabled yarn having a desired heathered color.

Cabled yarn, however, occasionally needs to be untwisted (i.e., separated into its individual yarn components) after being removed from, for example, a sample of unbacked carpet. Once untwisted, the individual yarn components can be tested to determine whether a particular yarn is causing a particular problem. In this regard, various known physical attribute tests may be performed on individual yarn components that cannot be performed on the cabled yarn, such as tests pertaining to yarn color, texture or the like.

According to the present invention, a cabled yarn untwister is provided that is configured to untwist cabled yarn into its individual yarn components so that the yarn components may then be subjected to physical attribute testing. In a particularly preferred embodiment, the cabled yarn untwister includes an untwister frame that is adapted to be rotated about its central longitudinal is by any suitable motorized drive unit (e.g., a hand-held electric drill). More specifically, the untwister frame most preferably is T-shaped and includes a connector leg that establishes the central longitudinal axis of the untwister frame. A forward end of the connector leg is rigidly connected to the medial ends of opposed yarn attachment arm which radially extend from the connector leg to thereby form the general T-shape of the untwister frame.

The connector leg rearwardly extends from the yarn attachment arms and terminates in a rearward end, which is configured to be attached to the motorized drive unit. Yarn attachment swivels are provided at each lateral end of the yarn attachment arms. The yarn attachment swivels thereby provide sites radially spaced from the central longitudinal axis of the frame to which respective yarn components of the cabled yarn may be attached (e.g., via tying).

With a length of the cabled yarn being held under tension, the motorized drive unit may then be operated so as to rotate the connector leg of the untwister frame in an untwisting direction about its central longitudinal axis. The yarn attachment swivels at each lateral end of the yarn attachment arms will thereby be driven in the untwisting direction so as to circumscribe a generally circular orbital path about the frame's central longitudinal axis. During such orbital movement, the yarn attachment swivels pivot about their respective swivel axes so to positionally maintain the orientation of the elongate axes of each of the individual yarn components. As such, the individual yarn components forming the cabled yarn may be untwisted from one another without themselves being twisted about their respective elongate axes during the untwisting operation.

These and further aspects and advantages of the present invention will become more clear after careful consideration is given to the following detailed description of a preferred exemplary embodiment thereof.

BRIEF DESCRIPTION OF THE DRAWINGS

Reference will hereafter be made to the accompanying drawings wherein like reference numerals throughout the various figures denote like structural elements, and wherein.

DETAILED DESCRIPTION OF PREFERRED EMBODIMENTS

Figure 1:
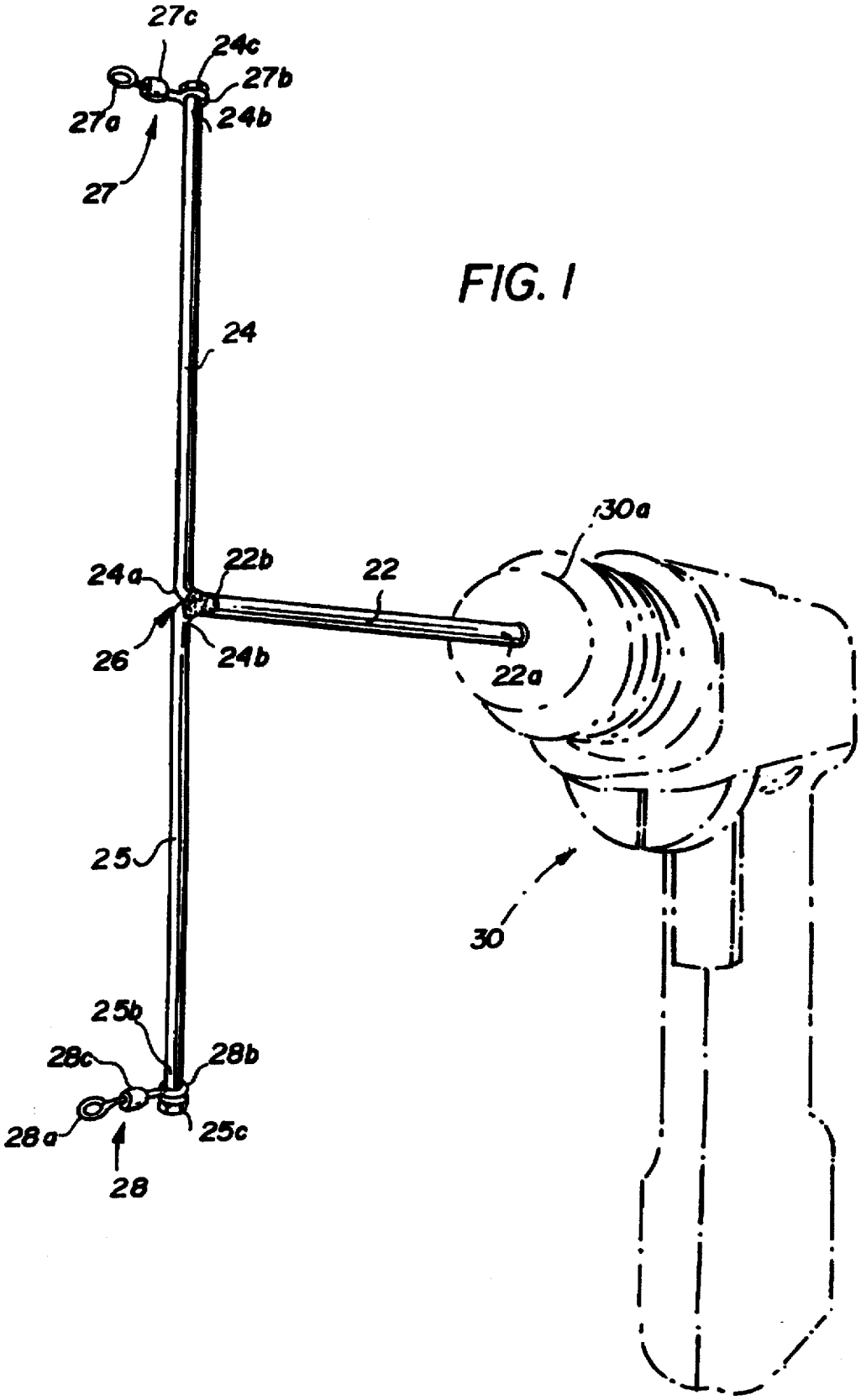
FIG. 1 is a front perspective view of a particularly preferred embodiment of a cabled yarn untwister according to the present invention.

As shown in FIG. 1, the cabled yarn untwister according to the invention generally includes a substantially T-shaped untwister frame 20, which is rotatably driven by a motorized drive unit, Such as a hand-held electric drill 30. In this regard, the embodiment depicted in FIG. 1 is especially adapted to being used as a hand-held device, and thus the use of a hand-held electric drill 30 is preferred. However, the untwister frame 20 may also be driven operatively by virtual any non-hand-held motorized drive unit that may be bench or table mounted, for example. For ease of discussion, however, reference will hereinafter be made to the hand-held drill 30 depicted in the accompanying drawing FIGURES since it represents a presently preferred form of a motorized drive unit to be used in combination with the untwister frame 20.

Figure 2:
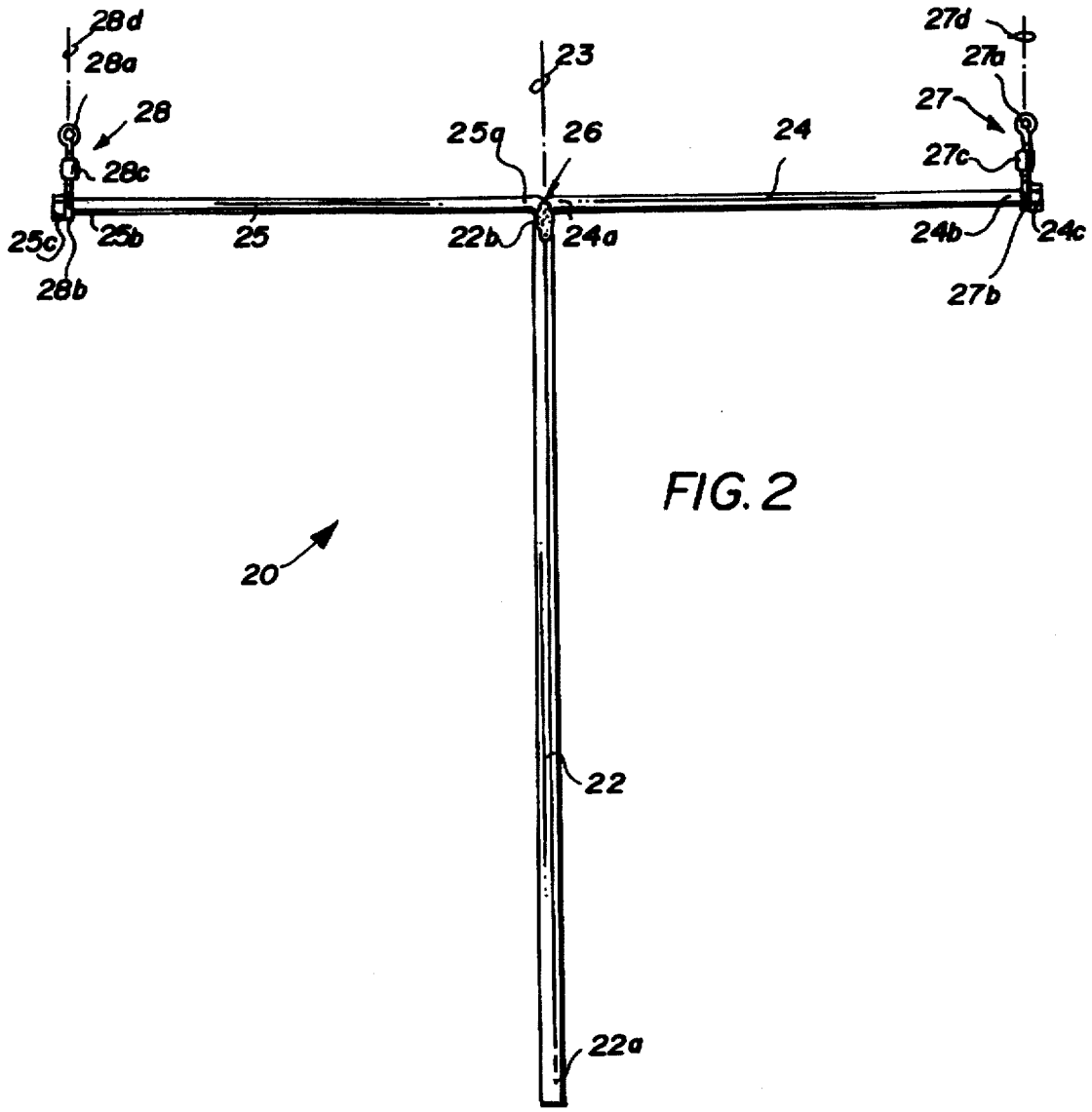
FIG. 2 is a top plan view of the cabled yarn untwister depicted in FIG. 1.

The structural components of the untwister frame 20 are perhaps more clearly depicted in accompanying FIG. 2. In this regard, it is evident that the untwister frame 20 includes an axially elongate connector leg 22, which establishes the central longitudinal axis 23 of the frame 20. The connector leg 22 has a rearward end **22*a* that is adapted and/or configured to be received and held operatively by the rotatable bit chuck 30*a* of the hand-held drill 30**.

The forward end **22*b* of the connector leg 22 is rigidly secured (e.g., via welding) at a midpoint location 26 to the opposed medial ends 24*a*, 25*a* of the radially opposed yarn attachment arms 24, 25, respectively. In this regard, the attachment arms 24, 25 may be separate structural components which are integrally connected to one another and to the forward end 22*b* of the connector leg 22. Alternatively, the arms 24, 25 may be formed of a unitary elongate structure that is attached substantially at its midpoint 26 to the forward end 22*b* of the connector arm 22. Furthermore, while it is presently preferred for the arms 24, 25 to be in a radially opposed relationship to form a general T-shape configuration of the frame 20, the arms 24, 25 could likewise be forwardly inclined or bowed so that the frame 20** assumes a general Y-shape configuration.

In the presently preferred embodiment of this invention, the connector leg 22 and the yarn attachment arms 24, 25 are each formed of ⅛-inch diameter stainless steel wires, which are welded to one another in the manner described above. Of course, other suitable rod-shaped structures of any desired cross-sectional geometry and/or size, and formed of sufficiently rigid materials (e.g., plastics) could be employed.

Yarn attachment swivels 27, 28 are secured to and forwardly project from the lateral ends **24*b*, 25*b* of the yarn attachment arms 24, 25, respectively. Each of the swivels 27, 28 includes a forward eyelet 27*a*, 28*a* that is sized to accommodate a respective one of the yarn components forming the cabled yarn to be untwisted. A suitable off-the-shelf structure that may be employed as the yarn attachment swivels 27, 28 is a standard fisherman's swivel, preferably size no 2. In this regard, the swivels 27, 28 will then include a rearward eyelet 27***b*, 28*b*, which may physically be sleeved over and epoxy-bonded to the shank of lateral cap bolts 24*c*, 25*c*. The cap bolts 24*c*, 25*c* are then rigidly secured to the lateral ends 24*b*, 25*b* of the arms 24, 25 by any suitable means, for example, via an epoxy adhesive, soldering or welding (if the materials forming the swivels 27, 28 and cap bolts 24*c*, 25*c* are compatible to being soldered or welded). Alternatively, the rearward eyelets 27*b*, 28*b* may be sleeved over the lateral ends 24*b*, 25*b* of arms 24, 25 and rigidly secured thereto by adhesive bonding, soldering and/or welding (again, if the materials forming the eyelets 27*b*, 28*b* and the lateral ends 24*b*, 25*b* are compatible to soldering or welding). The eyelets 27*a*, 27*b* and 28*a*, 28*b* are joined to one another via a swivel coupling 27*c*, 28*c*. With the eyelets 27*b*, 28*b* rigidly fixed to the lateral ends 24*b*, 25*b* of the arms 24, 25, the eyelets 27*a*, 28*a* will thereby be permitted to pivot freely about their respective swivel axes 27*d*, 28*d*.

Figure 3:
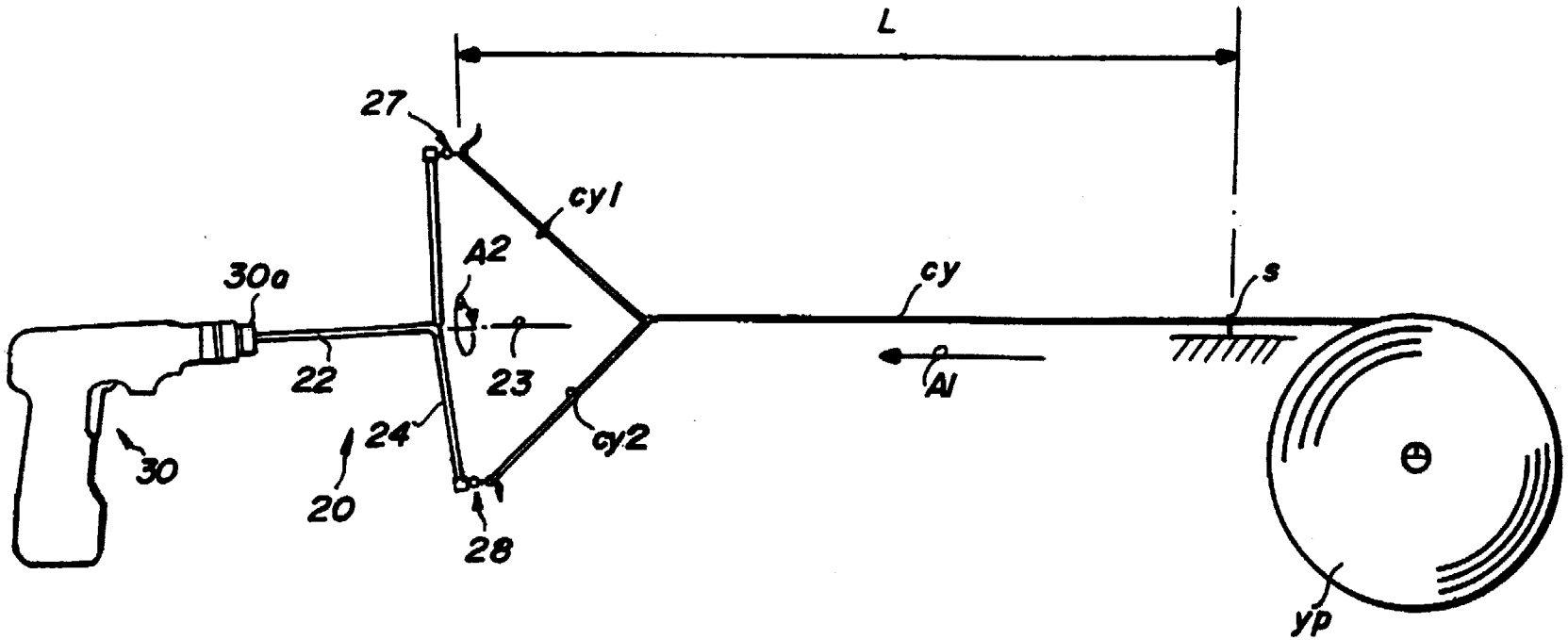
FIG. 3 schematically illustrates the cabled yarn untwister depicted in FIGS. 1 and 2 in use so as to untwist the individual yarn components of the cabled yarn.

In use, a length L of cabled yarn CY is first unwound from a cabled yarn package YP as shown in accompanying FIG. 3. The length L of cabled yarn CY is positionally restrained at its far end to a positionally filed structure S by tying, taping, stapling, tacking or the like. The individual yarn components CY1, CY2 at the near end of the cabled yarn CY are attached physically to a respective one of the yarn attachment swivels 27, 28, for example by tying the individual yarn components CY1, CY2 to the eyelets 27*a*, 28*a*, respectively. Any slack that may be present in the cabled yarn CY is removed (e.g., by the operator holding the drill 30 pulling against the fixed structure S in the direction of the arrow A1 shown in FIG. 3) so that the cabled yarn CY is maintained under tension. The hand-held drill 30 is then activated to cause its bit chuck to rotate, which in turn rotatably drives the untwister frame 20 in an untwisting direction (arrow A2 in FIG. 3). For example, when untwisting S-twist cabled yarns, the untwister frame 20 is rotated in a clockwise direction as viewed from the right of FIG. 3. Conversely, for Z-twist cabled yarns, the frame 20 is rotated in a counterclockwise direction as viewed from the right of FIG. 3. In such a manner, the individual yarn components CY1 and CY2 are thereby untwisted from one another along the fixed length L of the cabled yarn CY.

The swivels 27, 28 serve to axial stabilize the individual yarn components CY1, CY2 during the untwisting operation so as to prevent the yarn components CY1, CY2 from being twisted about their respective elongate axes. That is, since the yarn attachment swivels 27, 28 are capable of rotating freely about their respective axes 27*d*, 28*d*, the longitudinal orientation of the individual yarn ends CY1, CY2 attached to each of the eyelets 27*a*, 28*a* will remain substantially constant during orbital movement of the swivels 27, 28 about the central longitudinal axis of frame 20. As a result, the individual yarn components CY1, CY2 are not twisted about their respective elongate axes during the untwisting operation. The untwisted individual yarn components CY1, CY2 may then be subjected to physical property testing.

The frame 20 has been described previously as having a pair of yarn attachment arms 24, 25 and their associated yarn attachment swivels 27, 28 so as to untwist a pair of yarn components CY1, CY2, respectively. However, more than a pair of yarn attachment arms and associated swivels may be provided in accordance with the present invention so as to accommodate and untwist a corresponding number of individual yarn components. If more than a pair of such yarn attachment arms and swivels is provided, then it is preferred that the arms be angularly spaced apart at substantially equal intervals (e.g., so that substantially constant centrifugal forces are experienced by the arms during the unwinding operation).

Thus, while the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

I claim:

1. A cabled yarn untwister frame for untwisting individual yarn components of cabled yarn, comprising:

a rotatable elongate connector leg; and at least one pair of yarn attachment arms each extending radially outwardly from said connector leg in diverging directions, and having a medial end rigidly secured to said connector leg, and a lateral end for attachment to a respective one of the individual yarn components such that rotation of said connector leg in an untwisting direction causes said lateral ends of said yarn attachment arms to move in an orbital path thereabout, whereby the individual yarn components of the cabled yarn are untwisted from one another.

2. A cabled yarn untwister frame according to claim 1, further comprising yarn attachment swivels respectively positioned at said lateral ends of said yarn attachment arms.

3. A cabled yarn untwister frame according to claim 2, wherein said swivels are bonded to said respective lateral ends.

4. A cabled yarn untwister frame according to claim 2, wherein said swivels include a forward eyelet for attachment to a respective one of the individual yarn components of the cabled yarn.

5. A cabled yarn untwister frame according to claim 2, wherein said yarn attachment swivels include a forward eyelet for attachment to a respective one of the individual yarn components, a rearward eyelet rigidly connected to said respective one of said lateral ends of said yarn attachment arms, and a swivel connector coupling said forward and rearward eyelets to allow said forward eyelet to swivel freely relative to said rearward eyelet.

6. A cabled yarn untwister frame according to claim 1, wherein said yarn attachment arms are integrally welded to said connector leg.

7. A cabled yarn untwister frame according to claim 1, wherein said yarn attachment arms are unitary, and wherein said connector leg includes a forward end that is rigidly attached at substantially a midpoint of said unitary yarn attachment arms.

8. The combination comprising the cabled yarn untwister frame according to claim 1, and a motorized drive unit, wherein said connector leg establishes a central longitudinal axis of said cabled yarn untwister frame, and includes a rearward end that is coupled operatively to said motorized drive unit, said motorized drive unit for rotating said connector leg in an untwisting direction to thereby responsively cause said lateral ends of said yarn attachment arm to move in said orbital path about said central longitudinal axis.

9. A cabled yarn untwister for untwisting cabled yarn into individual yarn components, comprising:

an axially elongate connector leg having rearward and forward ends;

a yarn attachment arm rigidly secured and disposed substantially perpendicular to said forward end of said connector leg, said yarn attachment arm having opposed lateral ends radially spaced from said connector leg for attachment to a respective individual yarn component of the cabled yarn; and a motorized drive unit operatively coupled to said rearward end of said connector leg for rotating said connector leg in an untwisting direction to thereby responsively cause said lateral ends of said yarn attachment arms to move in an orbital path thereabout, whereby the individual yarn components of the cabled yarn are untwisted from one another.

10. A cabled yarn untwister according to claim 9, further comprising a pair of swivels, each attached to a respective one of said opposed lateral ends for attachment to a respective one of the individual yarn components.

11. A cabled yarn untwister according to claim 9, wherein said motorized drive unit is a hand-held electric drill.

12. A method of untwisting individual yarn components of a fixed length of cabled yarn comprising:

(a) attaching the yarn components to respective opposed ends of a yarn attachment arm associated with a rotatable yarn untwisting frame;

(b) tensioning the fixed length of cabled yarn; and (c) maintaining axial orientation of the individual yarn components while rotating the yarn untwisting frame in an untwisting direction to responsively cause said opposed ends of said yarn attachment arm to orbit in a path about the tensioned fixed length of cabled yarn, whereby the individual yarn components of the cabled yarn are untwisted from one another.

13. The method of claim 12, wherein said step of maintaining axial orientation of the individual yarn components includes allowing the individual yarn components to rotate about their respective axes relative to the respective opposed ends of the yarn attachment arm.

14. A method of untwisting individual yarn components of cabled yarn, comprising:

(a) physically attaching the individual yarn components of the cabled yarn to a respective swivel attachment associated with a T-shaped frame of an untwisting device; and (b) rotating the T-shaped frame of the untwisting device in a direction to untwist the individual yarn components of the cabled yarn from each other.

15. The method of claim 14, which further comprises the step of maintaining the cabled yarn under tension while practicing said step (b).

16. The method of claim 14, which further comprises obtaining a predetermined length of cabled yarn, positionally fixing a far end of the cabled yarn, and physically attaching the individual yarn components of the cabled yarn to the untwisting device at a near end of the cabled yarn.

* * * * *